US005193813A

United States Patent [19]

Goff

[11] Patent Number: 5,193,813

[45] Date of Patent: Mar. 16, 1993

[54] METHOD OF PLAYING THREE-DIMENSIONAL CUBIC CHESS

[76] Inventor: Allan Goff, 8265 Central Ave., Orangevale, Calif. 95662

[21] Appl. No.: 698,488

[22] Filed: May 8, 1991

[51] Int. Cl.[5] ..... A63F 3/02

[52] U.S. Cl. ..... 273/241

[58] Field of Search ..... 273/241, 261, 287

[56] References Cited

U.S. PATENT DOCUMENTS

| | | | |
|---|---|---|---|
| 3,767,201 | 10/1973 | Harper | 273/241 |
| 3,937,471 | 2/1976 | Brennan | 273/241 |
| 4,179,127 | 12/1979 | Goodman | 273/241 |
| 4,927,157 | 5/1990 | Riihiluoma | 273/260 |
| 5,031,917 | 7/1991 | Greene | 273/241 |

FOREIGN PATENT DOCUMENTS

| | | | |
|---|---|---|---|
| 386445 | 1/1923 | Fed. Rep. of Germany | 273/260 |
| 2838140 | 9/1978 | Fed. Rep. of Germany | 273/241 |
| 3104612 | 2/1981 | Fed. Rep. of Germany | 273/241 |
| 601062 | 5/1945 | United Kingdom | 273/241 |
| 1283840 | 8/1972 | United Kingdom | 273/241 |

OTHER PUBLICATIONS

"Space Chess" by Earl W. Major, Presented to the Patent Office on Jul. 26, 1973.

Chess Variations by John Gollon, Three-Dimensional Chess pp. 228-229.

Advertisement in House Beautiful, Nov. 1967.

Advertisement in Sears catalog, Jan. 1976.

Advertisement in Time Magazine, Feb. 4, 1952.

3-D Chess Manual, Allan Goff, 1990.

*Primary Examiner*—Benjamin H. Layno

*Attorney, Agent, or Firm*—John P. O'Banion

[57] ABSTRACT

Three-dimensional chess played on a cubic playing field where moves are executed in cubic planes, and up to one-thousand playing positions are available. Ten boards are mounted over each other, each board defining a ten by ten matrix of one-hundred squares. The game is played by two opponents, each having a king, queen, two knights, two bishops, two rooks, two dukes, and ten pawns, the introduction of a duke being required for true three-dimensional movement of the playing pieces. Playing pieces move in reference to advancement squares, each piece having a defined planar movement pattern. Play on an eight by eight by eight or on an eight by eight by ten playing filed configuration is possible by permitting the duke to occupy the same square as the bishop.

11 Claims, 17 Drawing Sheets

METHOD OF PLAYING THREE-DIMENSIONAL CUBIC CHESS

BACKGROUND OF THE INVENTION

1. Field of the Invention

This invention pertains generally to three-dimensional chess, and specifically to three-dimensional chess in which moves are executed in flat planes through cubic cells.

2. Description of the Background Art

In two-dimensional chess, playing pieces move in straight lines. In forms of three-dimensional chess heretofore developed, multiple playing boards are used and the rules of play dictate that the playing pieces still move in straight lines, now vertically as well as horizontally. Often, the set of playing pieces is multiplied so that a complete set is placed on each board.

For example, U.S. Pat. No. 4,179,127 issued to Goodman on Dec. 18, 1979 discloses a playing board for three-dimensional chess which has 8 rows of 10 squares so that chess can be played side to side as well as front to back. The playing board is stair-stepped in its configuration so as to simulate the perspective of a battle zone. The game is played by moving playing pieces both between and within discrete horizontal planes.

U.S. Pat. No. 3,937,471 issued to Brennan on Feb. 10, 1976 discloses using two 8×8 chess boards stacked one over the other, as well as two conventional sets of chessmen. Two additional sets of chessman are used, each additional set having (1) at least one additional royalty piece chosen from the group consisting of: queen, bishop, rook, and knight; and (2) a minimum of one additional pawn and at least the same number of additional pawns as there are queen and rook royalty pieces in each of the additional sets. The playing pieces may be moved between boards in transcendental moves.

U.S. Pat. No. 4,927,157 issued to Riihiluoma et al. on May 22, 1990 discloses a chess-like game which has two game boards, the first board having 42 squares. An element of chance is introduced into the game by rolling a die.

U.S. Pat. No. 3,767,201 issued to Harper et al. on Oct. 23, 1973 discloses a multi-level chess board which has a standard center board, and boards mounted over each other such that each board above and below the center board has two less rank and file rows than the adjacent board to the direction of the center board. The game is played in the conventional manner except that the game pieces may be moved in both horizontal and vertical directions.

German Patent No. 2,838,140 discloses three dimensional chess played on eight boards, each with sixty four squares, mounted one above the other forming a total of 512 squares. The game pieces can be moved in the conventional manner as well as vertically between boards.

German Patent No. 3,104,612 discloses a top transparent board and a bottom squared board, hinged together such that the top board can pivot 90 degrees in relation to the bottom board, permitting the color of the squares to be changed vertically.

British Patent No. 601,062 discloses a three-dimensional chess game in which the game pieces move between 4 conventional 8×8 boards.

Several publications also disclose variations of three-dimensional chess. For example, an advertisement in House Beautiful dated November, 1967 shows a three dimensional chess game using 8 stacked boards and 128 chessmen. An advertisement in the Sears catalog dated prior to January, 1976 shows a 3 level space chess game. Finally, an advertisement in Time Magazine dated Feb. 4, 1952 shows a three-dimensional chess game with 128 chessmen and eight levels of play.

Conventional thinking has led to the forms of three-dimensional chess disclosed in the foregoing patents and publications being played much like two-dimensional chess. Pieces are moved in straight lines on a board as well as between boards. However, this is not true three-dimensional chess. True three-dimensional chess requires that the playing pieces move in flat planes through cubic cells and has not heretofore been disclosed.

The foregoing patents and publications reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

This present invention pertains to a method of playing cubic planar chess on a playing field which is 10×10 with 10 levels, or on a more conventional playing field which is 8×8 with 8 levels. The 10×10×10 playing field is a cube of 1000 cubic playing cells and exists as the purest embodiment of the game. The 8×8××8 playing field is a cube of 512 cubic playing cells. In both embodiments, the game is played with an additional piece which is called a duke. In the 10×10×10 embodiment the duke occupies its own starting position on the playing field, whereas in the 8×8×8 embodiment the duke starts on the same cell as the bishop and can occupy the same cell as the bishop during moves. Other embodiments of the playing field, all of which are based upon planar moves, are an 8×8×10 playing field which has 640 cells but is not cubical in and of itself, and an 8×8×8 playing field of 512 cells but without the duke as a playing piece.

Cubic planar chess as disclosed herein requires that the playing pieces move in flat planes on a playing field which is arranged as a regular array of cubic cells. In two-dimensional chess the board is arranged as an array of square cells and there is precisely one base piece for every way that one might move to an adjacent cell; that is, rooks move through sides and bishops move through corners. In cubic planar chess, there are three base pieces because there are three ways to move to adjacent cells; that is, rooks move through faces, bishops move through edges, and dukes move through corners. The duke, which is an additional piece over conventional chess, is required because there must be one base piece for every feature of a cell, which is now cubic. A cube has three features by which it is in contact with adjacent cubes; faces, edges, and corners. A base piece is defined as a piece which can move to an adjacent cell through only one feature.

In cubic planar chess, a piece begins at a square and ends at a square but does not occupy any squares in between. As the piece advances it defines a set of squares that must be unoccupied if the move is to be unblocked. This set of squares is called an advancement square. While advancing, the piece is not actually "occupying" the advancement square but is moving over it. The piece advances by adding successive perimeters to its advancement square, which in most cases lie within a single quadrant. A piece advances through a quadrant by adding one perimeter at a time to its advancement square. Linear moves are also permitted, and such moves lie in two quadrants in the same plane. The advancement square is then the union of the individual advancement squares from each quadrant.

An object of the invention is to provide a three-dimensional chess game with the feel of two-dimensional chess.

Another object of the invention is to move playing pieces in planes through cubic cells.

Another object of the invention is to provide a three-dimensional chess game where the rules of play are congruent with two-dimensional chess.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Referring more specifically to the drawings, for illustrative purposes the present invention is generally shown in FIG. 1 through FIG. 12. It will be appreciated that the present invention may vary as to the physical configuration and method of use without departing from the basic concepts as disclosed herein.

Figure 1:
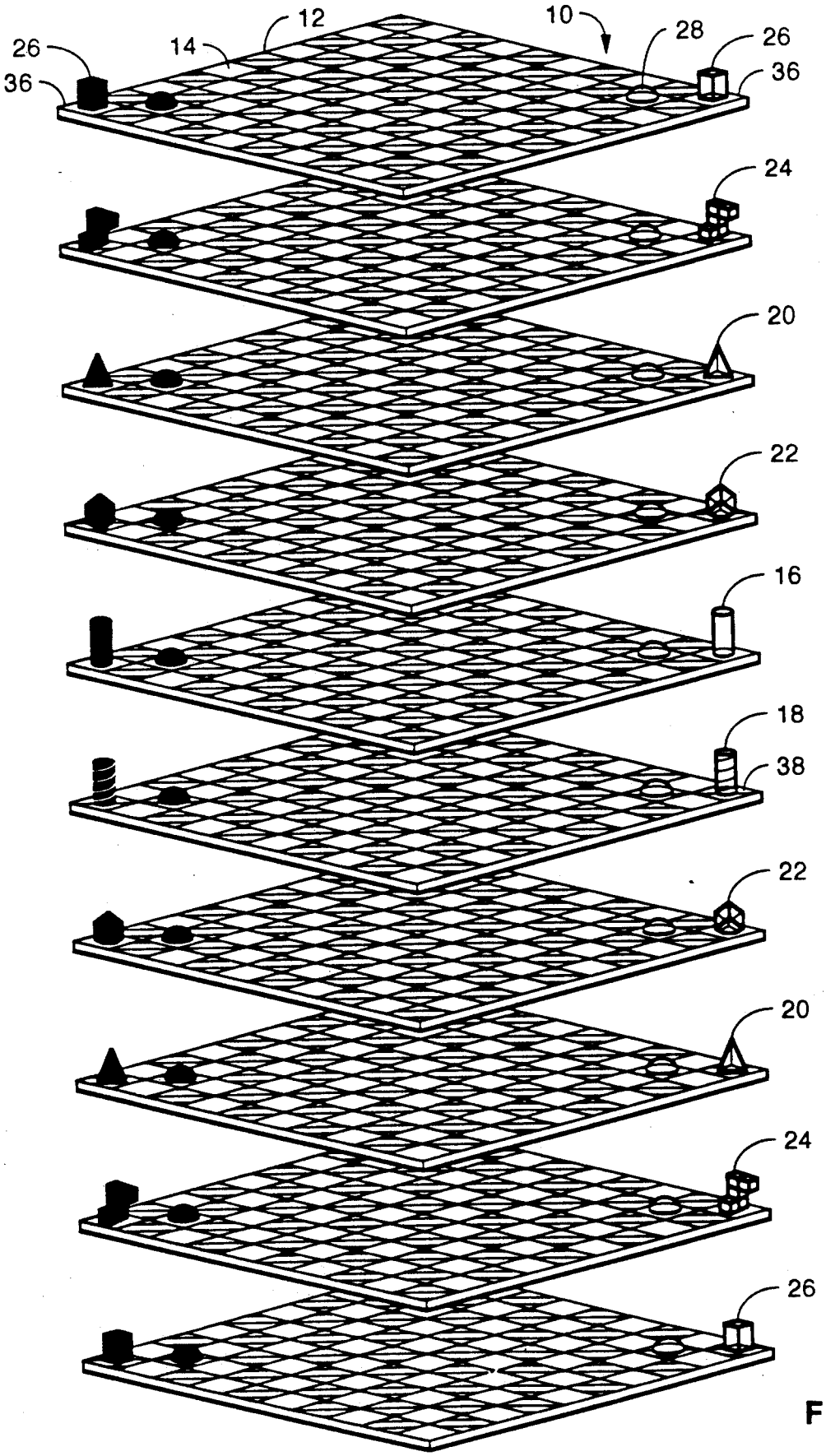
FIG. 1 is a perspective view of the playing field for the present invention showing the starting line-up of the playing pieces.

Referring to FIG. 1, the preferred embodiment of the invention is played on a cubic playing field 10 comprising a plurality of generally flat boards 12 positioned at vertically spaced levels. Each board 12 typically includes one-hundred flat squares 14 which, when viewed with reference to a vertically adjacent board, actually forms one-hundred cubic cells, the number of squares on each edge of the board 12 being equal. Use of ten boards 12 presents a cubic playing field which comprises one-thousand cells, or cubes. The playing field 10 should be thought of as a cube of cubes, even though the physical configuration of the boards has been elongated vertically with levels in between so that the pieces can be conveniently moved. Other playing fields can be used, such as eight by eight by ten or eight by eight by eight, requiring a slightly different manner of play as discussed later. Alternating cells are colored as white and black, as are the playing pieces, similar to conventional chess.

For ease of reference, the present invention will be referred to as cubic planar chess. It will also be stipulated that the playing pieces rest on squares, not in cubes, so that the location of a piece is with reference to a square it is on rather than the cube in which is lies. The latter, however, is a more accurate representation.

Cubic planar chess requires the use of three base pieces. A base piece is a piece which can move to an adjacent cell through only one feature. A feature is a point of contact with an adjacent cell. A cube has three features by which it is in contact with adjacent cubes; faces, edges, and corners. Therefore, there must be three base pieces in cubic planar chess.

Figure 2:
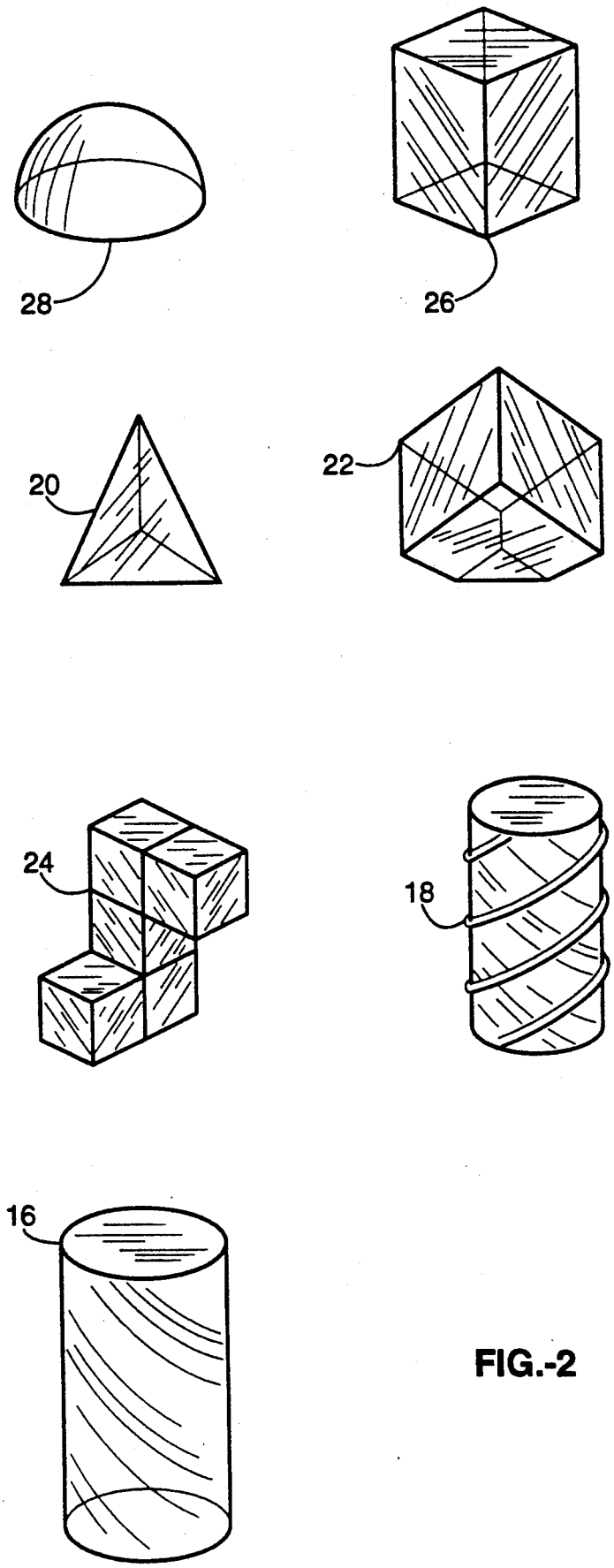
FIG. 2 is a plan view identifying the playing pieces of the present invention.

Referring to FIG. 2, the playing pieces utilized in cubic planar chess are the king 16, queen 18, bishop 20, duke 22, knight 24, rook 26, and pawn 28. The playing pieces are broken into two distinguishable sets, one being colored white and the other being colored black, each of which contains one king, one queen, two bishops, two dukes, two knights, two rooks, and ten pawns. The base pieces are defined as bishop 20, duke 22, and rook 26. Note that duke 22 is a piece which does not exist in conventional chess, whether two-dimensional or three-dimensional, and is required because there are three features of a cube. Major playing pieces are all playing pieces other than pawns.

Figure 3A:
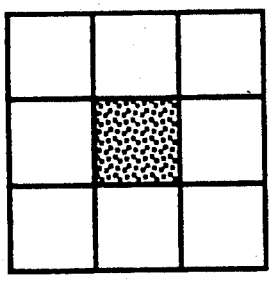
FIG. 3A through 3G show the relationship of movement of base playing pieces to adjacent cells in the present invention to movement of base playing pieces in two-dimensional chess.
Figure 3B:
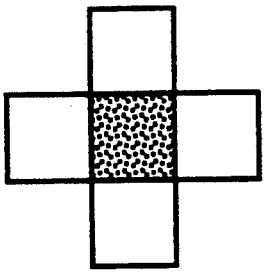
Figure 3C:
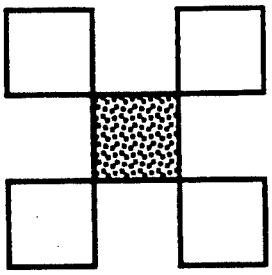

In two-dimensional chess a unit cell is a square. Referring to FIG. 3A which shows a three by three portion of a two-dimensional playing field, a square embedded in an array of squares is in contact with adjacent squares by its sides and corners. Therefore, a square has two features by which it is in contact with adjacent squares; sides and corners. A rook positioned in the center of the array can move to adjacent squares only through the adjoining sides (FIG. 3B), and a bishop to adjacent squares only through the adjoining corners (FIG. 3C).

Figure 3D:
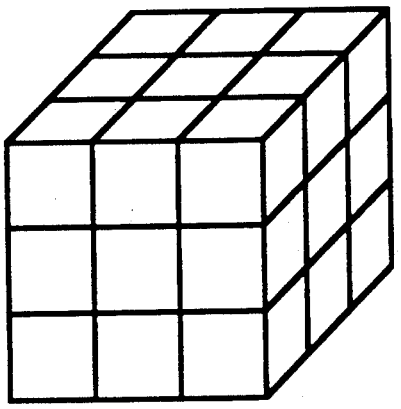
Figure 3E:
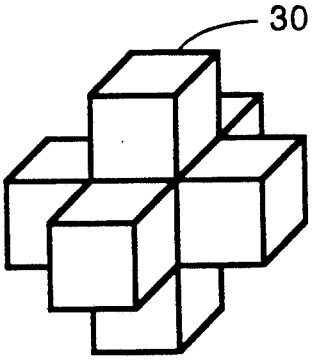
Figure 3F:
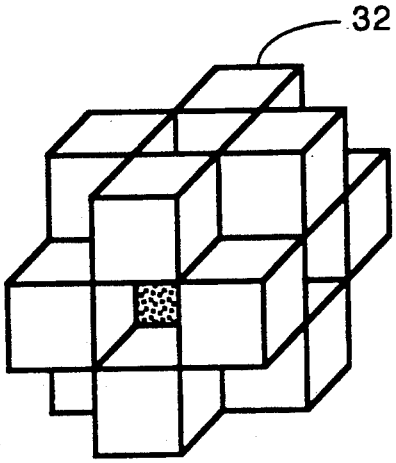
Figure 3G:
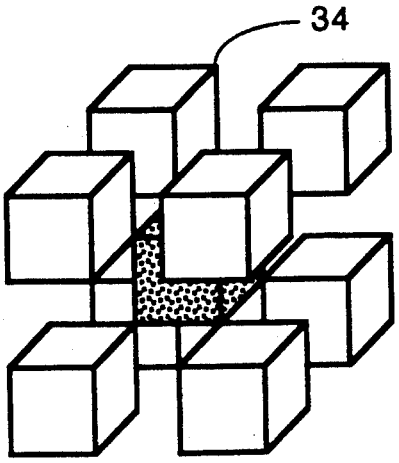

In cubic planar chess the unit cell is a cube. Referring to FIG. 3D which shows a three by three by three portion of playing field 10, there are a total of twenty-six adjacent cells. Because a cube has three features which can be in contact with adjacent cells, that is, faces, edges and corners, there are three ways to move to adjacent cells. Viewed from the center of the array, rooks move through faces 30 (FIG. 3E), bishops move through edges 32 (FIG. 3F), and dukes move through corners 34 (FIG. 3G). The moves for the remaining playing pieces are then defined in terms of the base pieces.

Referring again to FIG. 1, cubic planar chess requires that, in their starting position, the playing pieces line up vertically on opposite edges of the playing field 10, or home column, with pawns 28 positioned diagonally in front of the major pieces by one cell. King 16 is positioned above queen 18 and the king's rooks 26 for either player are positioned on a white square 36 on the top level. Note also that both players' queens 18 are positioned on a black square 38, which is different than conventional chess where both queens and each king's rook is on a square of its own color. As in conventional chess, white moves first.

Figure 4A:
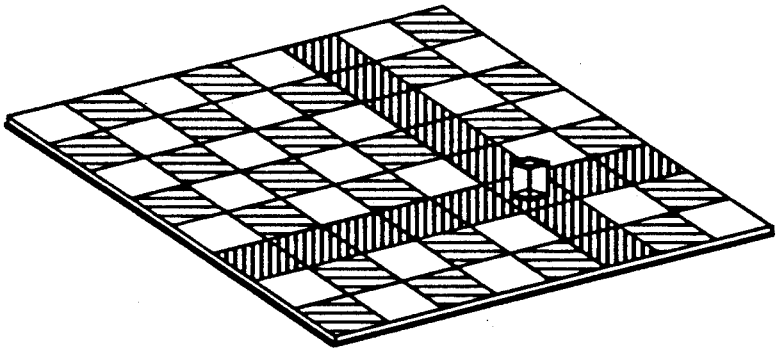
FIG. 4A through 4C are diagrammatic views comparing the advancement pattern of the playing piece called a rook on a portion of the playing field in the present invention to that of a rook in two-dimensional chess.
Figure 4B:
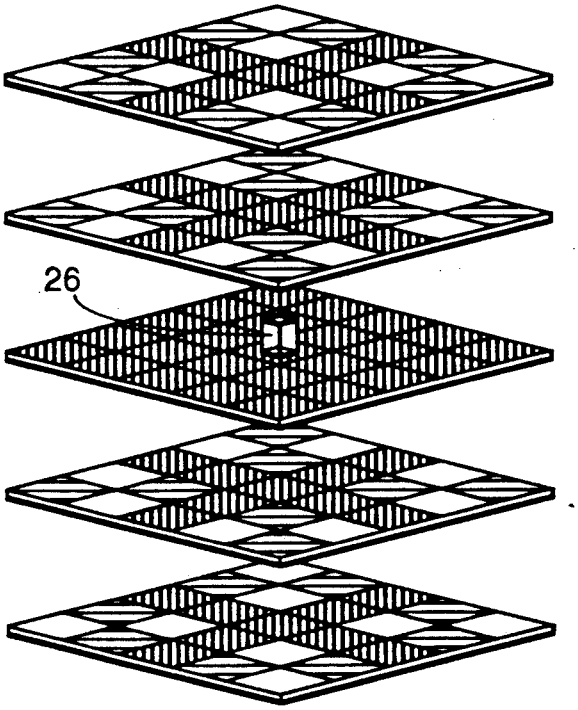
Figure 4C:
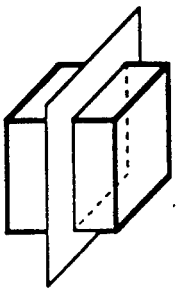

Referring to FIG. 4A which shows a conventional chess board, in two-dimensional chess a rook moves in either of two orthogonal directions, and a rook is always at the intersection of two orthogonal lines. Referring to FIG. 4B which shows a five by five by five array of cells from the center of playing field 10, in cubic planar chess rook 26 advances in one direction from cube to cube through the faces connecting them, and then may advance in another direction at right angles to the first, continuing to advance from cube to cube through the faces that connect them. In other words, rook 26 moves within one of three orthogonal planes, except when it makes a linear move in which case it simultaneously moves in two planes. A linear move is like movement in a straight line as found in conventional chess. Any other planar move is referred to as a quadrant move. Referring to FIG. 4C, an orthogonal plane cuts one full face off the playing field. From the corner of the playing field, the planes that rook 26 can move in form three of the six sides of a cube. Therefore, the shape of rook 26 has been selected to be cubical, although elongated for aesthetic reasons. Rook 26 can get to every cell of the playing field, and it can get from any cell to any other cell in two moves. When rook 26 advances it creates a square plane, or advancement square, one corner of which starts at its original position and extends so that the final position of rook 26 is anywhere on the opposite perimeter.

Figure 11A:
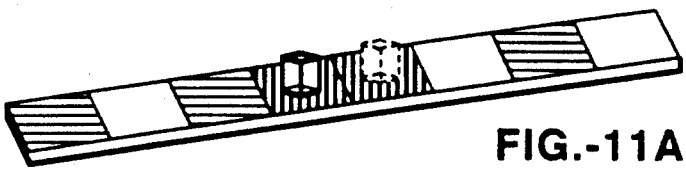
FIG. 11A through 11F are diagrammatic views showing advancement squares for the playing piece called a rook during planar moves in the present invention compared to those in two-dimensional chess.
Figure 11B:
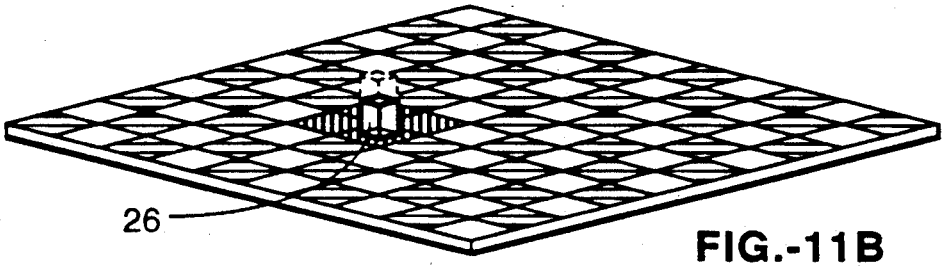
Figure 11C:
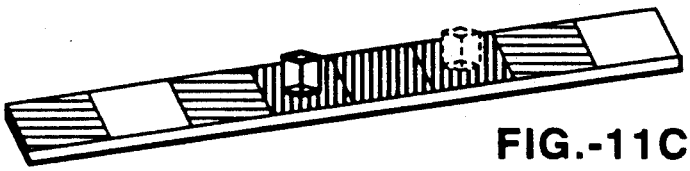
Figure 11D:
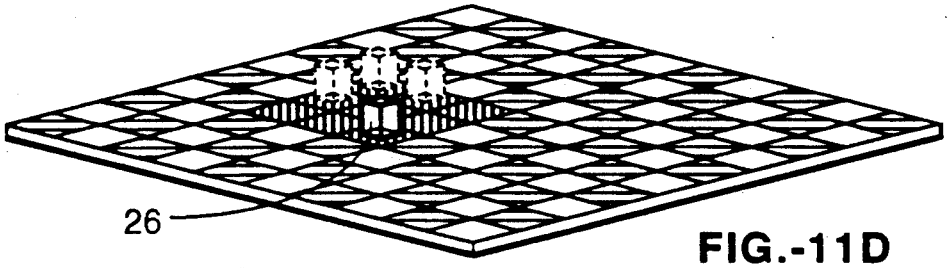
Figure 11E:
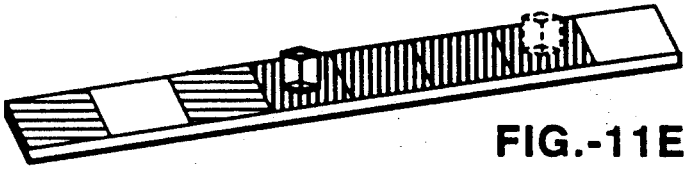
Figure 11F:
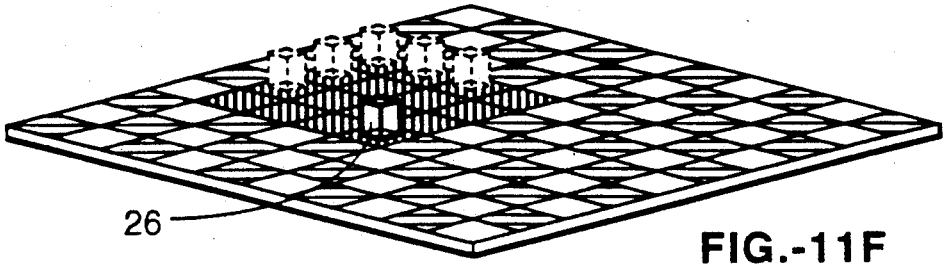

FIGS. 11A, 11C and 11E show how a rook advances by one, two and three squares, respectively, in a single orthogonal row in two-dimensional chess. FIGS. 11B, 11D and 11F show advancement of rook 26 by one, two and three squares, respectively, in a single orthogonal plane in cubic planar chess. In two-dimensional chess, the rook's advancement creates a straight line which starts at the rook's original position and extends to its final position. In cubic planar chess, advancement of rook 26 creates a square plane, called an advancement square, one corner of which starts at the original position of rook 26 and extends so that the final position of rook 26 is anywhere on the opposite perimeter. Note that, while movement has been shown in a horizontal plane, rook 26 can also move in both orthogonal vertical planes.

Figure 12A:
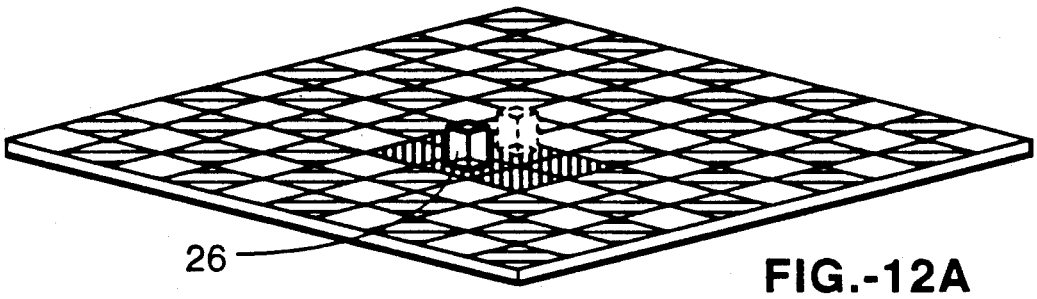
FIG. 12A through 12C are diagrammatic views showing advancement squares for the playing piece called a rook during linear moves in the present invention compared to those in two-dimensional chess.
Figure 12B:
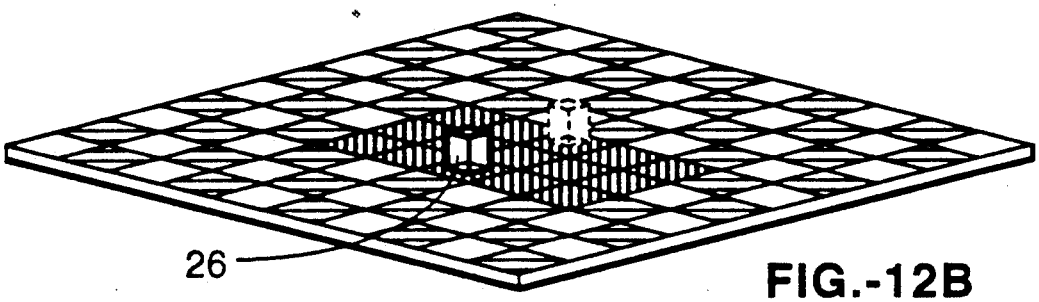
Figure 12C:
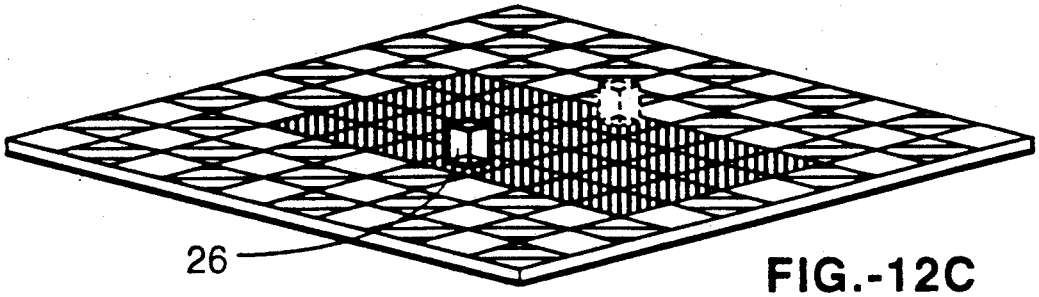
Figure 13:
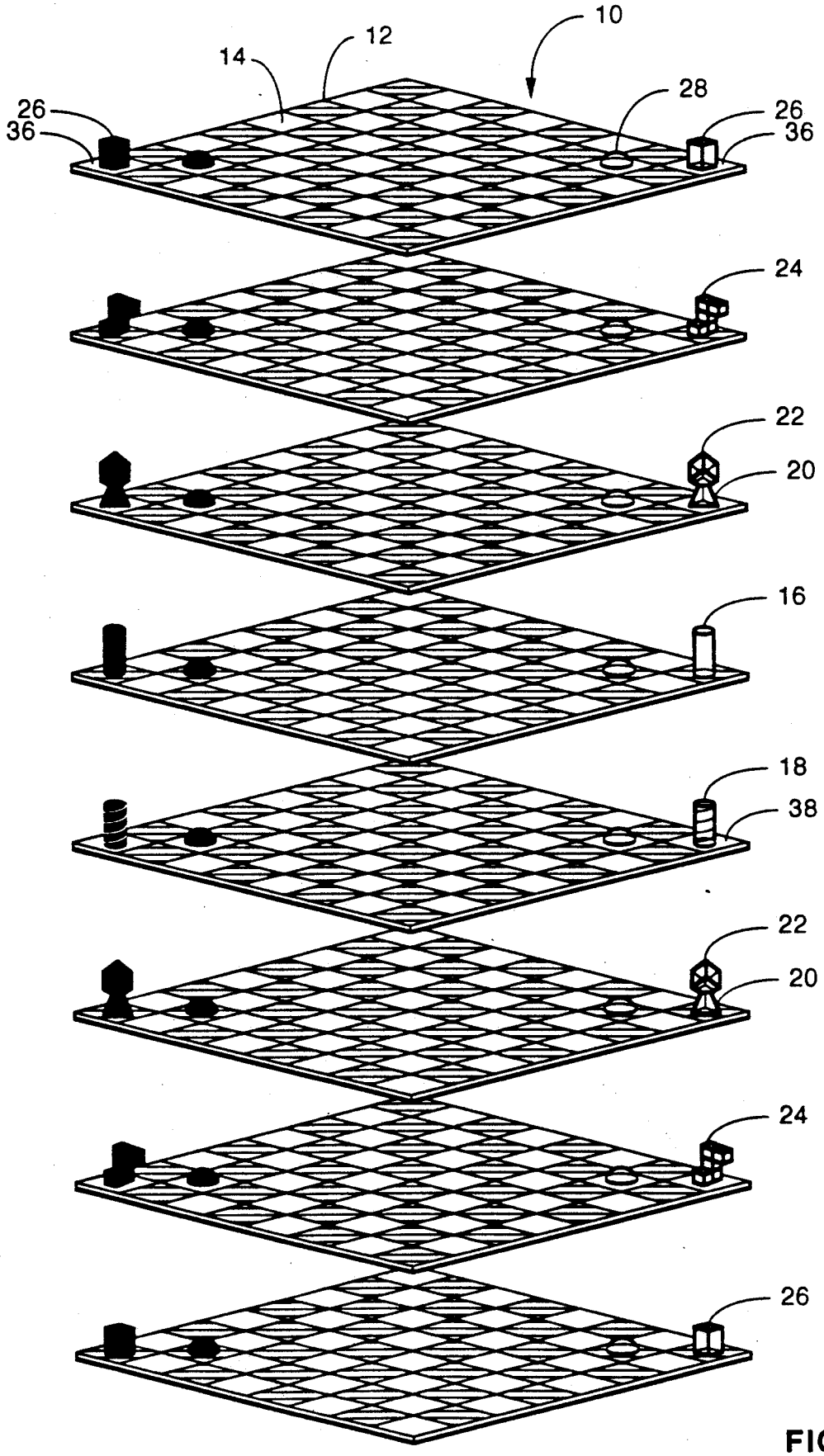
FIG. 13 is a perspective view of an eight by eight by eight embodiment of the playing field showing the starting line-up of the playing pieces.
Figure 14:
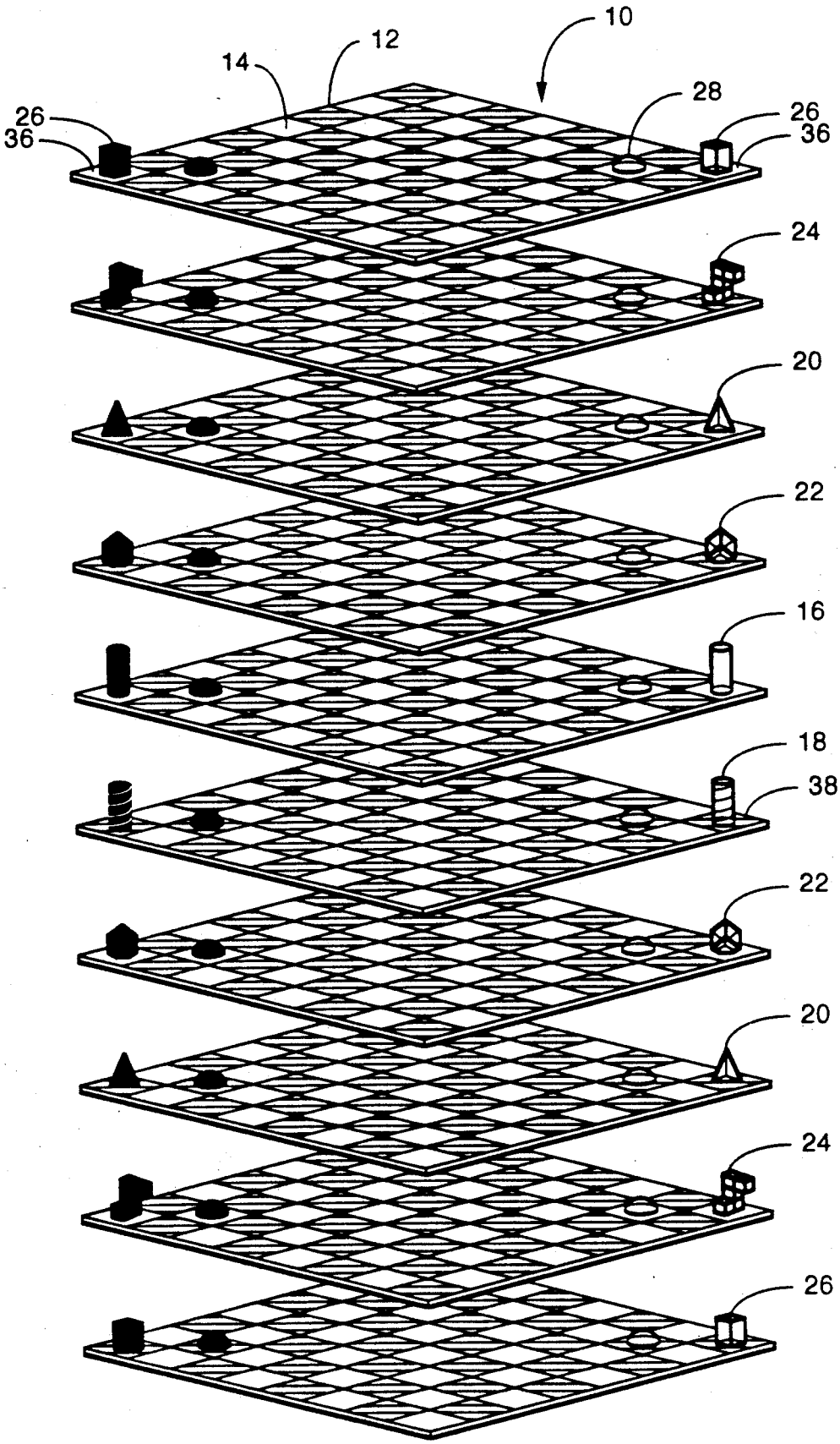
FIG. 14 is a perspective view of an eight by eight by ten embodiment of the playing field showing the starting line-up of the playing pieces.

When rook 26 makes a linear move, it is ambiguous which quadrant it moved in so it is considered to move in both. FIGS. 12A, 12B and 12C show rook 26 making a linear advance by one, two and three squares, respectively. While it may look at first glance like the linear move is easier to block because there are nearly twice as many squares which may contain obstructing pieces, it is not. Since rook 26 has moved simultaneously in two planes, its move is unblocked if the advancement square in either one is free of other playing pieces. Therefore, rook 26 actually has twice the opportunity to be unblocked. Note also that rook 26 cannot move from its starting position on playing field 10 unless either its pawn 28 or knight 24 next to it move first.

Rook 26 can move both in horizontal and in vertical planes, and divides each of its three planes into four quadrants, which are separated by two straight lines. When rook 26 makes a linear move, it is considered to have moved in two quadrants, the advancement square covering both quadrants and having a rectangular shape.

Figure 5A:
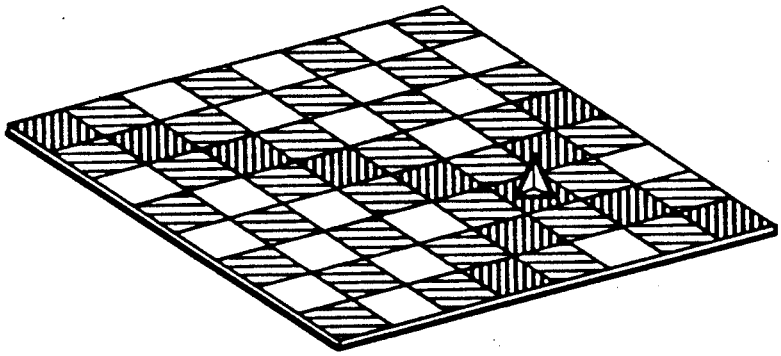
FIG. 5A through 5C are diagrammatic views comparing the advancement pattern of the playing piece called a bishop on a portion of the playing field in the present invention to that of a bishop in two-dimensional chess.
Figure 5B:
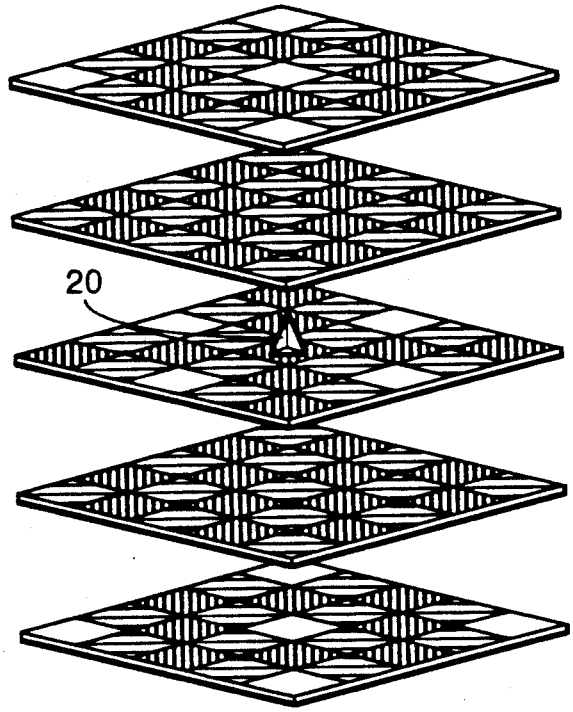
Figure 5C:
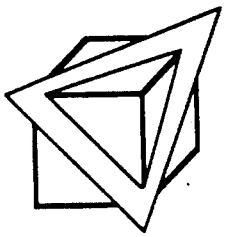

Referring to FIG. 5A which shows a conventional chess board, in two-dimensional chess a bishop moves diagonally, advancing from square to square in a straight line through the corners connecting them. Referring to FIG. 5B which shows a five by five by five array of cells from the center of playing field 10, in cubic planar chess bishop 20 advances in one direction from cube to cube through the edges connecting them, and then may advance in another direction at a one-hundred and twenty degree angle to the first direction, continuing to advance from cube to cube through the edges that connect them. Bishop 20 moves within one of four skew planes, except when it makes a linear move in which case it simultaneously moves in two planes. Referring to FIG. 5C, a skew plane cuts at least one corner off of the playing field. From the corner of the playing field, the planes that bishop 20 can move in form three of the four sides of a tetrahedron. Therefore, the shape of bishop 20 is tetrahedral. Bishop 2 is always positioned at the intersection of four skew planes; two lean outward, and two lean forward from one opponent to the other. When Bishop 20 is in the corner, the size of one plane is only a single square. While bishop 20 can get to only half of the cells on the playing field, it can get from any one cell to any other cell within that half in just two moves. Furthermore, if it starts on a black square it can only move to black squares; if its starts on a white square, it can only move to white squares.

Bishop 20 divides each of its four planes into six areas separated by three straight lines. When bishop 20 makes a linear move, the advancement square covers two quadrants. Like rook 26, bishop 20 moves simultaneously in two planes when it makes a linear move.

Figure 6A:
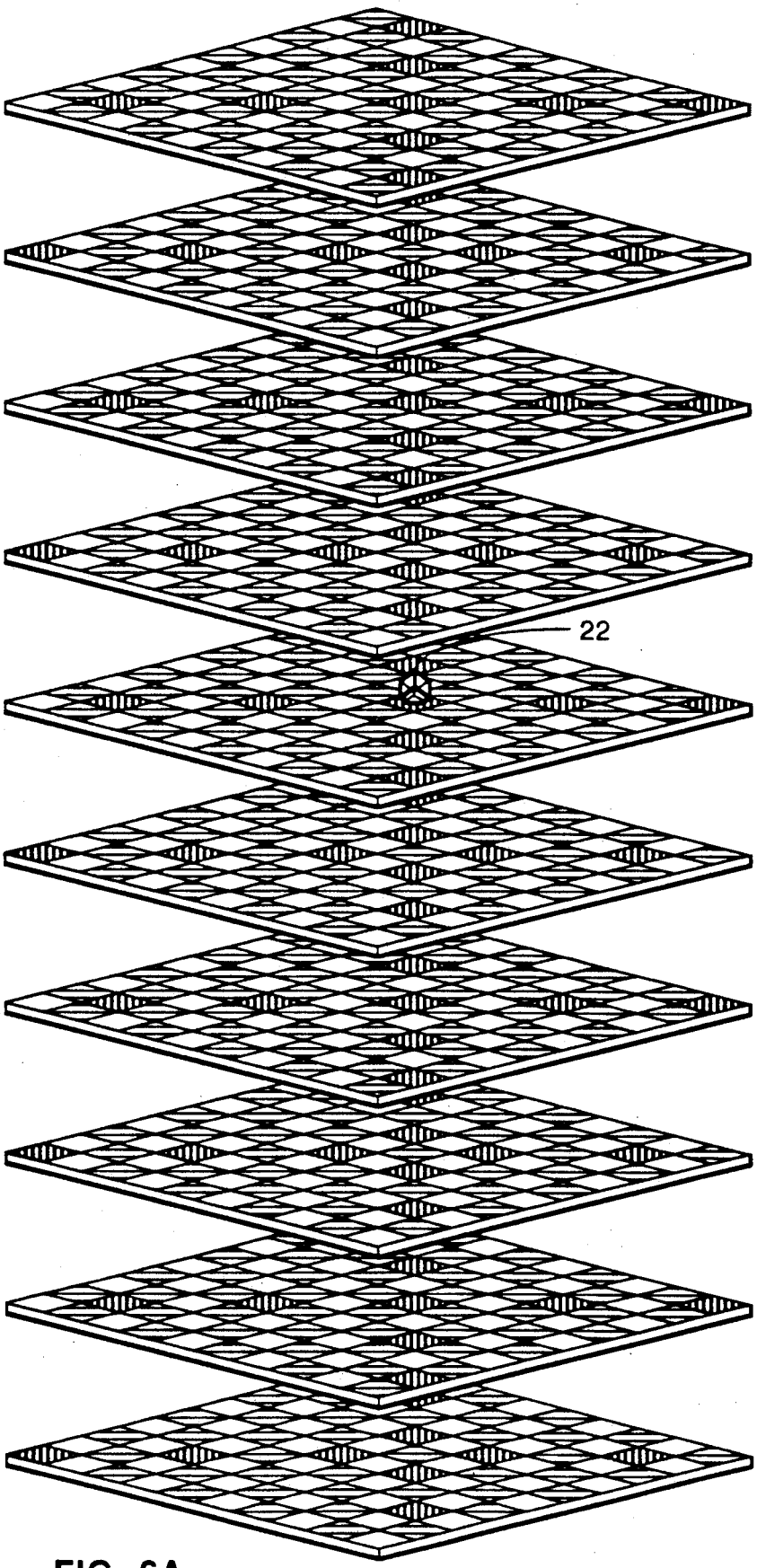
FIG. 6A through 6F shows a diagrammatic view of the advancement pattern of the playing piece called a duke in the present invention, represented as cross-pairs of slant planes.
Figure 6B:
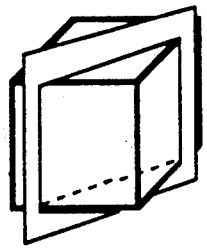
Figure 6D:
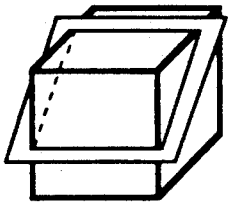
Figure 6F:
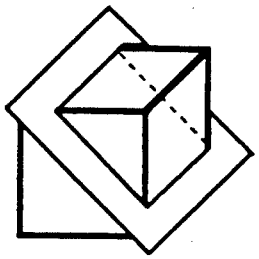
Figure 6C:
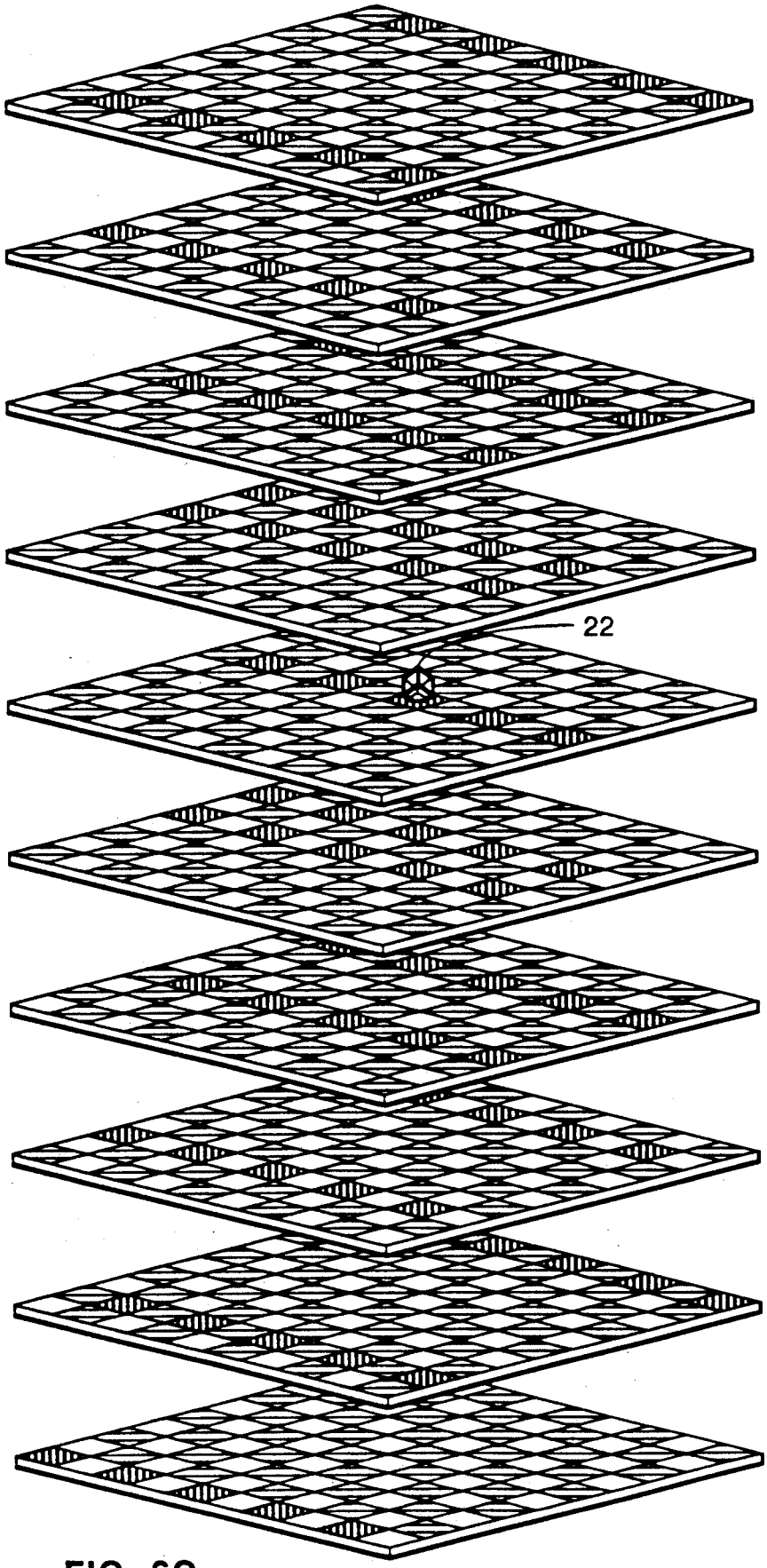
Figure 6E:
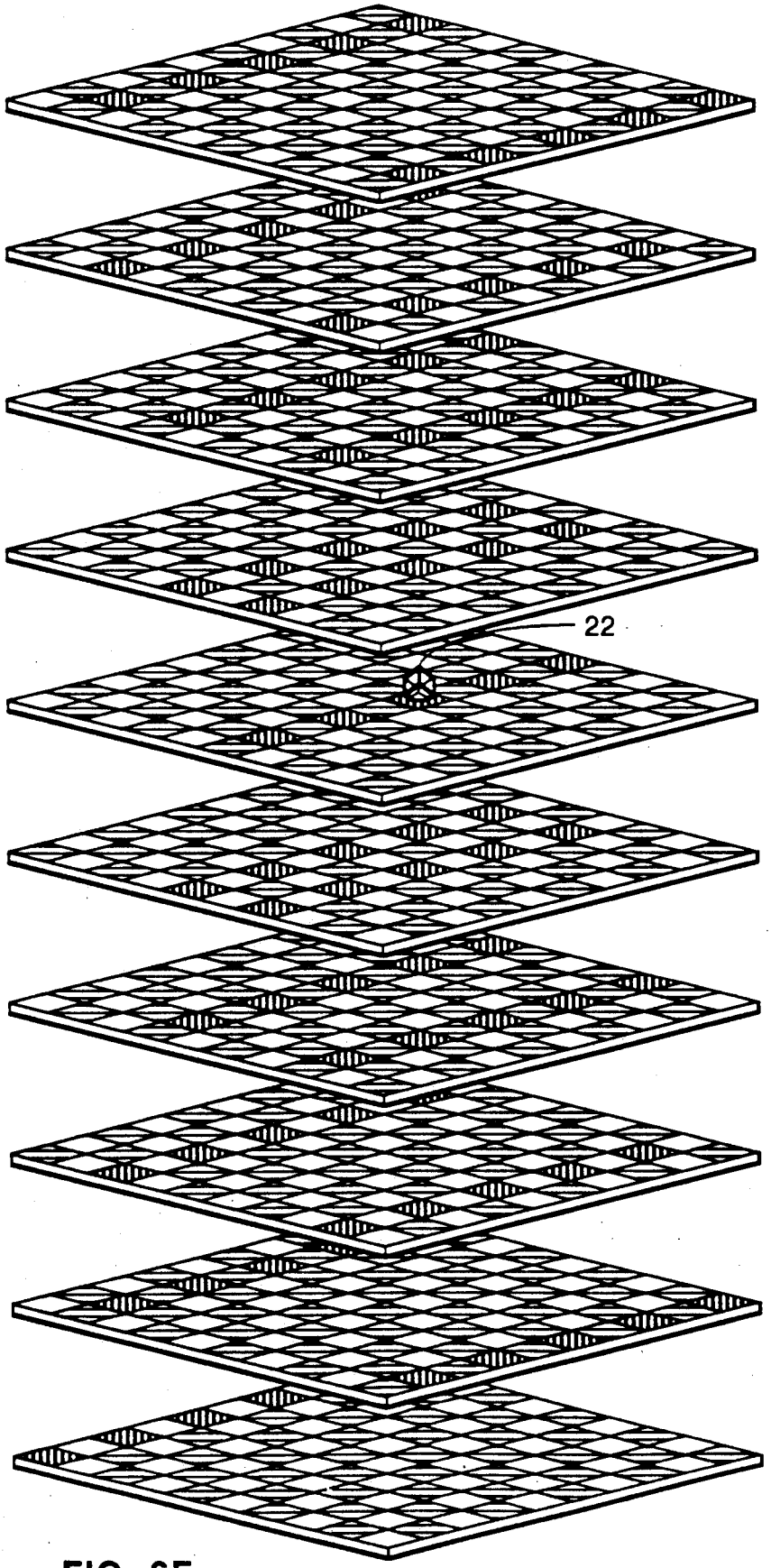

In two-dimensional chess there is no playing piece congruent with a duke in cubic planar chess. In cubic planar chess, the duke is to a bishop much like a bishop is to a rook. Duke 22 moves in one of six slant plans, except when it makes a linear move in which case it simultaneously moves in three of them. Because duke 22 is in so many planes at once, it is difficult to clearly see them in one drawing figure. Therefore, for clarity the planes are shown two at a time in cross-pairs. Referring to FIG. 6B, 6D and 6E, a slant plane cuts one full edge off of the playing field. FIG. 6A shows a major and minor slant plane; FIG. 6C shows the left cross-planes; and FIG. 6E shows the right cross-planes. Duke 22 advances in one direction from cube to cube through the corners connecting them, and then may advance in another direction at right angles to the first, continuing to advance from cube to cube through the corners that connect them. Since duke 22 moves through corners, the shape of duke 22 is an upended cube, flattened on the bottom to stay upright. Duke 22 is always at the intersection of six slant planes. Their sizes vary with its position but, unlike bishop 20, duke 22 can get to only half of the cells in its type of plane. When duke 22 is in the corner of the playing field 10, three of its planes consist of five cells, and three of them consist of fifty cells. Duke 22 divides each of its six planes into four areas, separated by two straight lines. Like rook 26, duke 22 makes linear moves which cover both adjacent quadrants. Duke 22 can get to only one quarter of all of the cells on the playing field, although it can get from any one cell to any other cell within that quarter in two moves.

Figure 7A:
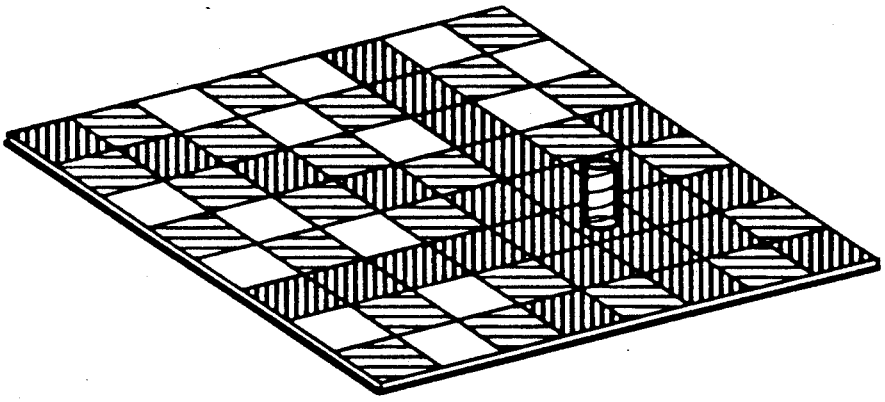
FIG. 7A and 7B are diagrammatic views comparing the advancement pattern of the playing piece called a queen in the present invention to that of a queen in two-dimensional chess.
Figure 7B:
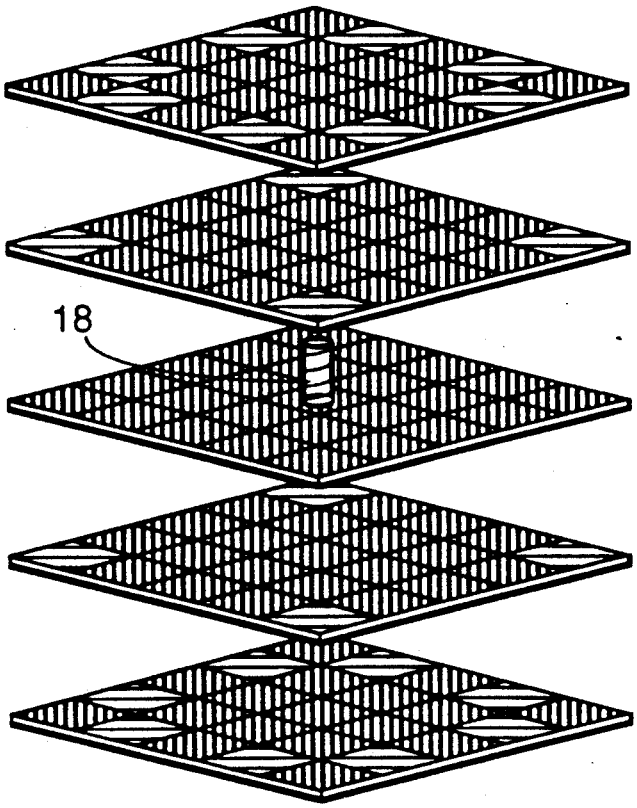

Referring to FIG. 7A which shows a conventional chess board, in two-dimensional chess a queen moves like either of the two base pieces, the rook and bishop; that is, in straight lines which are either orthogonal or diagonal. Referring to FIG. 7B which shows a five by five by five array of cells from the center of playing field 10, in cubic planar chess queen 18 may move like any of the three base pieces; that is, like rook 26, bishop 20, and duke 22. Because the movement of queen 18 is a complicated intertwining of the base piece moves, the shape of queen 18 is slender and twisted. Note, however, that queen 18 is more powerful than the sum of the base pieces since queen 18 has the ability to choose which base piece it desires to move like.

Figure 8A:
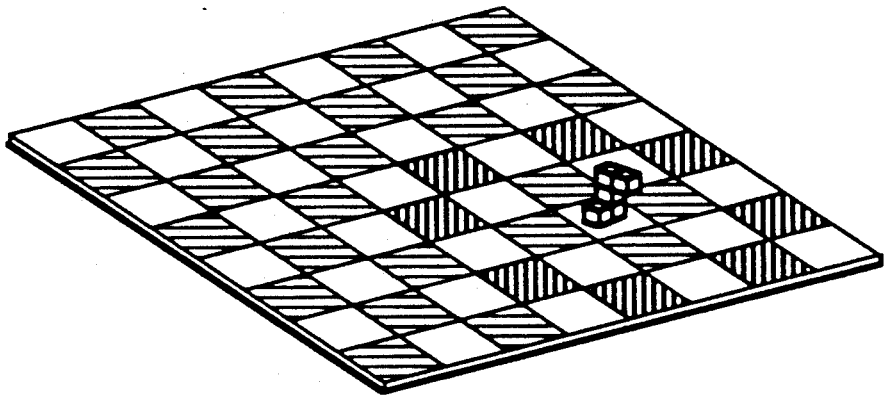
FIG. 8A and 8B are diagrammatic views comparing the advancement pattern of the playing piece called a knight on a portion of the playing field in the present invention to that of a knight in two-dimensional chess.
Figure 8B:
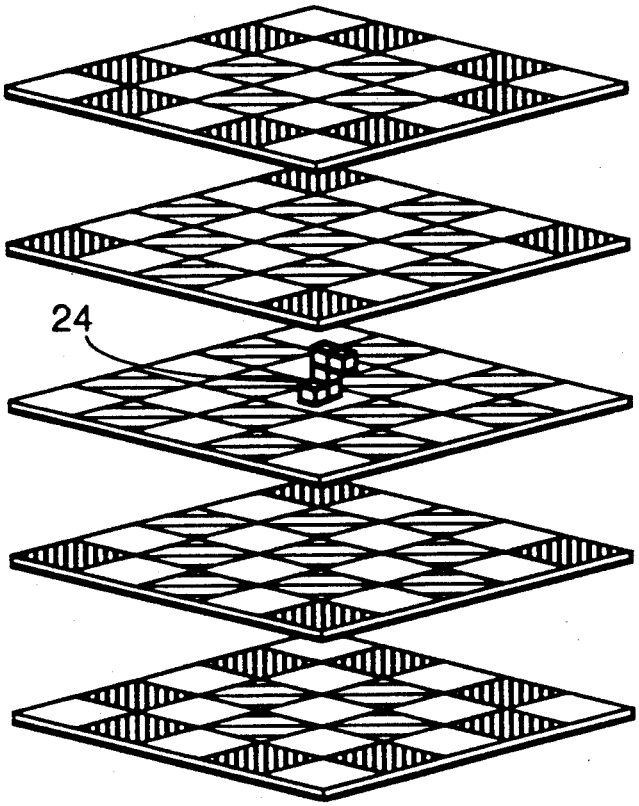

Referring to FIG. 8A which shows a conventional chess board, in two-dimensional chess the knight move is traditionally described as "L-shaped," a pattern of two squares by one square and cannot be blocked since, unlike any other playing piece, a knight jumps instead of advancing, passing over squares instead of through them. In cubic planar chess, the knight move can best be understood by recognizing that the knight is limited to moving to precisely those squares in a five by five array of squares to which a queen cannot move. Referring to FIG. 8B which shows a five by five by five array of cells from the center of playing field 10, in cubic planar chess knight 24 moves by jumping to only those squares that queen 18 cannot get to from the center of a five by five by five array of squares. Therefore, knight 24 can get to the twenty-four of the one-hundred and twenty-five squares within the five by five by five array that queen 18 cannot reach. Thus it can be noted that knight 24 is antithetical to queen 18 as is the case in two-dimensional chess. Queen 18 has unlimited range, whereas knight 24 has limited range. While queen 18 advances, knight 24 jumps. The nearest cells which queen 18 cannot reach are precisely the ones that knight 24 can reach. Therefore, it follows that queen 18 and knight 24 cannot simultaneously attack each other.

The movement of knight 24 can be described as moving along a path two squares in one orthogonal direction, two more squares in another, and one final square in the last orthogonal direction. The movement of knight 24 can also be described as moving two squares in a diagonal direction, and one square in an orthogonal direction at right angles. Knight 24 can reach every square on the playing field 10 although, unlike rook 26, it may take many moves to get from any particular square to another. The shape of knight 24 is a precise replica of its move viewed as three orthogonal path segments.

Figure 9A:
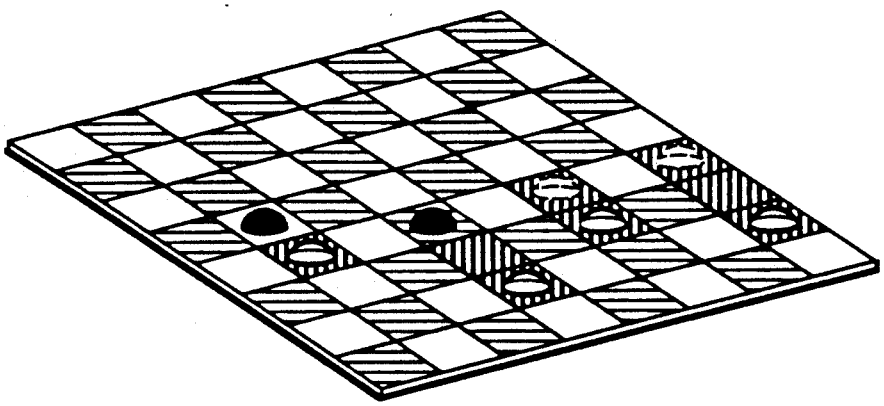
FIG. 9A and 9B are diagrammatic views comparing the advancement pattern of the playing piece called a pawn on a portion of the playing field in the present invention to that of a pawn in two-dimensional chess.
Figure 9B:
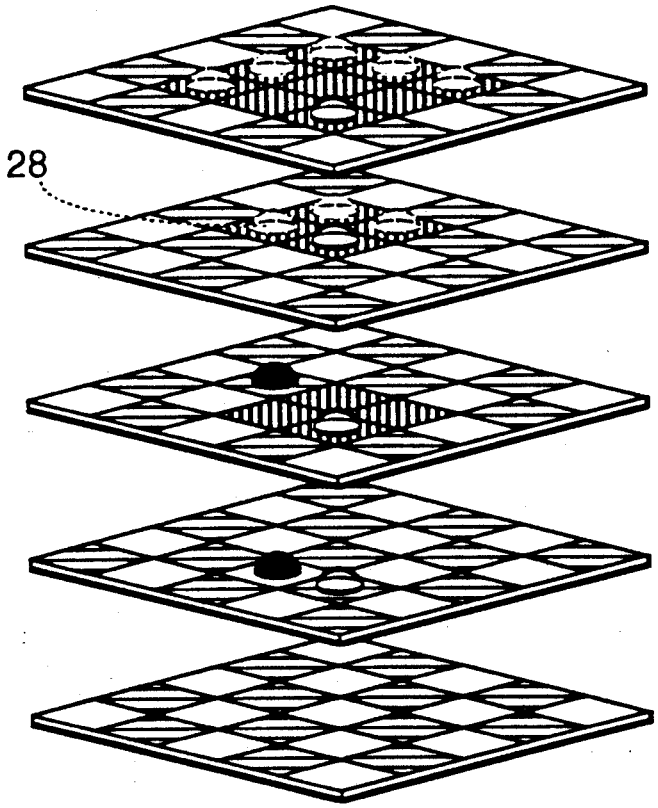

The pawn is the only piece which captures differently than it moves. Referring to FIG. 9A which shows a conventional chess board, in two-dimensional chess a pawn advances in a straight line but captures diagonally. In other words, a pawn advances like a rook but captures like a bishop. Referring to FIG. 9B which shows a five by five by five array of cells from the center of playing field 10, in cubic planar chess pawn 28 advances like rook 26 and captures like the other bases pieces; that is, bishop 20 and duke 22. Pawn 28 attacks either like bishop 20 or duke 22, precisely one level up or down, and the advancement squares for capture are appropriately modified to match the restrictions on its bishop and duke-like attacks. Pawn 28 may advance only one square at a time, except on the first move when it may advance two squares. Pawn 28 attacks only to the adjacent level, there are no squares to which it can both advance and attack, and it must move or capture toward the opponent's home row (or column); that is, pawn 28 is restricted to capturing another playing piece precisely one level away. Its shape is a hemispherical button shape, sufficiently lowly and nondescript to go with the relative lack of power inherent in its moves. Pawn 28 may advance in only one quadrant in the horizontal plane and in no quadrant of the other two orthogonal planes. Similar to two-dimensional chess, en passant is allowed although, in cubic planar chess, there are six possible engagements. Because pawn 28 may advance in only one quadrant, the shape of the advancement square for pawn 28 is always square, even for a linear move.

Figure 10A:
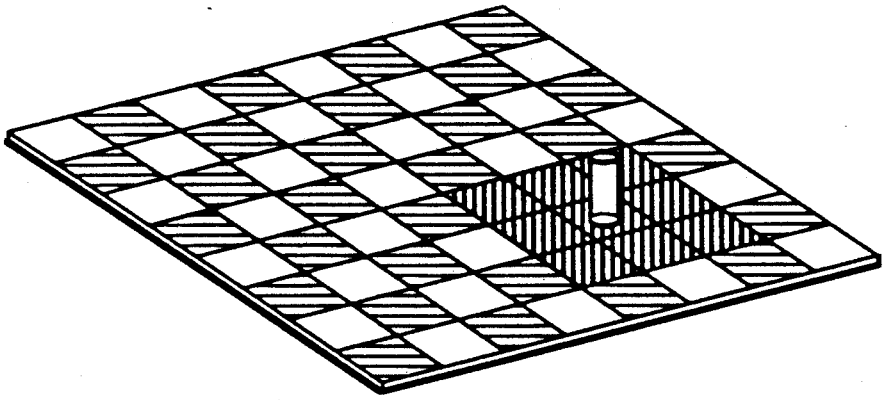
FIG. 10A and 10B are diagrammatic views comparing the advancement patterns of the playing piece called a king on a portion of the playing field in the present invention to that of a king in two-dimensional chess.
Figure 10B:
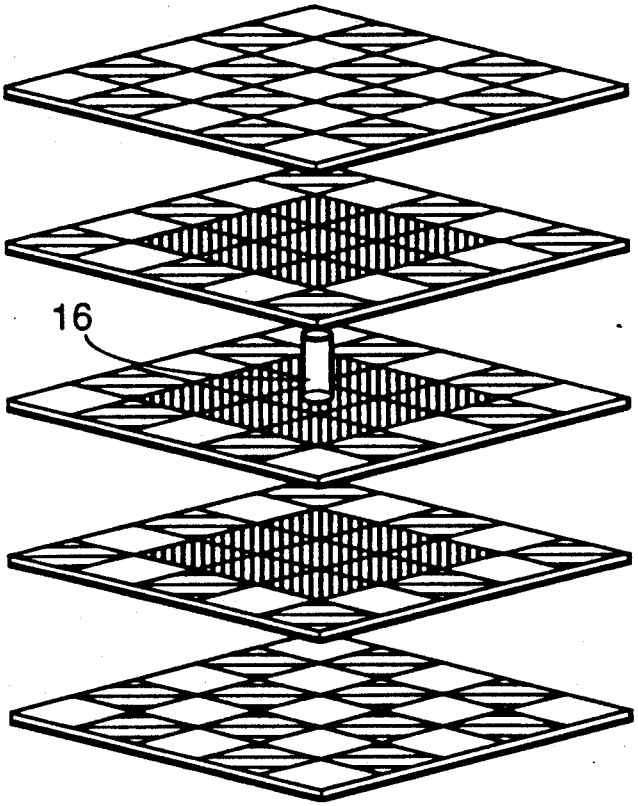

Referring to FIG. 10A which shows a conventional chess board, in two-dimensional chess a king can move to any adjacent square. However, the queen can also move to those squares. Therefore, a king moves like a queen but can only move to adjacent squares. Referring to FIG. 10B which shows a five by five by five array of cells from the center of playing field 10, in cubic planar chess king 16 can move like queen 18 but only to adjacent cubes, of which there are twenty-six. Since king 16 can reach every square around it, its shape is that of a cylinder. King 16 advances into a face cell with the same linear moves as rook 26. King 16 may also advance into an edge cell using the quadrant move of rook 26 or the linear move of bishop 20. Lastly, king 16 may advance into a corner cell using the linear move of duke 22. Note, however, that unlike pawn 28 the advancement squares of king 16 are not truncated to those squares he cannot immediately reach. While pawn 28 cannot return to a square it has passed, king 16 can. This means that while king 16 cannot move to the far corner of an advancement square, it can be quantum blocked by a piece located there. Quantum blocking occurs as a result of another playing piece being located in the advancement square, even though the other playing piece is not directly in the path of the playing piece to be moved. There are two important consequences of this rule. First, king 16 cannot move from the starting line-up unless a neighboring piece, or a pawn two levels away, moves first. Second, the behavior of king 16 will not differ from that of queen 18 in close encounters, similar to conventional chess. Note also, that it takes four pieces to hem king 16 into a corner. To hem king 16 away from the edge of the playing field, it takes fourteen pieces; four placed on face squares to prevent a rook move; six placed on edge squares, four to prevent a bishop move and two more to prevent a quadrant rook move; and four placed on corner squares to prevent a duke move.

There is also a unique restriction with regard to a checking move. King 16 cannot remain on a square where any of the opponent's pieces could, in principle, capture it. King may get out of check in three ways; by moving, by blocking the attacking piece, or by capturing the attacking piece. The game is lost when king 16 is in check and cannot get out of check. If king 16 cannot move out of check, block the check, or capture the checking piece, he is in checkmate and the game is over.

There is also a unique restriction with regard to castling. Similar to castling in two-dimensional chess, in cubic planar chess simultaneous movement of the king and rook is restricted. In castling, king 16 and one rook may both move simultaneously under very restricted conditions. Both king 16 and the involved rook must not have been moved before, there must be no pieces between them, and king 16 cannot be moving out of check, through check, or into check. However, in cubic planar chess castling is considerably more complicated that in conventional chess. First, castling may occur in either of the two vertical planes. Second, because of the size of the playing field 10, king 16 advances three levels instead of only two squares. Third, because of planar moves, neither king 16 nor the involved rook is confined to the home column. King 16 may move to any of the four squares on his destination level that are within its advancement square, and similarly for the involved rook who has three squares when king-side castling, and four squares when queen-side castling. Both pieces must move in the same plane, however, and both of their advancement squares must be unblocked. Fourth, defining what is meant by passing through check is not trivial. If there is no path that avoids a check, then king 16 has passed through check and castling is not allowed. A path is defined as a sequence of stopover squares through which king 16 would have passed had he made the equivalent move in precisely three single steps instead.

Opening moves in the present invention are very different than those in conventional chess, partly due to the larger-sized playing field 10 in the present invention. For example, with a ten by ten by ten playing field, it takes the limited-range pieces longer to engage the center of the playing field, while on an eight by eight by eight playing field, as in conventional chess, opposing pawns may engage each other in a single move each. On the ten by ten by ten playing field, it takes two moves each.

Cubic planar chess requires the application of several important rules. The standard game is played on a playing field which is ten by ten by ten; that is, a cube of cubes. Other sized playing fields could be used such as eight by eight by eight, in which case duke 22 shares an initial position with bishop 20, and both playing pieces can occupy the same cell during and after movement. An eight by eight by ten playing field could be used, making for better pawn play at the expense of a playing field which is not symmetrical. Cells are alternately colored black and white. Cubic planar chess is a symmetrical two person game; one player's set of pieces is referred to as white, the other's as black. Each set of pieces comprises one king, one queen, two knights, two bishops, two knights, and two dukes. The base pieces are ordered with respect to the minimum number of orthogonal coordinates which change when the piece moves to an adjacent cell.

A cell can contain one piece, or none, except in the case of an eight by eight by eight playing field where the bishop and duke may share the same cell. The starting line-up in cubic planar chess is a vertical line, on opposite edges of the playing field, with the pawns diagonally in front of the major pieces by one square. The king is above the queen and the king's rooks for both white and black are on a white square on the top level. Both queens are on a black square. Players stand opposite each other with the playing field lined up diagonally, so that the major diagonal of white squares on the top level extends from one player to the other.

The rules of motion in cubic planar chess are critical. As a piece advances, it defines a set of squares that must be unoccupied if the move is to be unblocked; that is, an advancement square. An advancement square grows by many squares at a time; that is, the number on the advancing perimeter. Each piece is assigned a unique movement pattern, some pieces being more powerful than others. A piece moves in cubic planes, which makes the present invention challenging and unique.

As discussed above, an alternative embodiment of cubic planar chess uses an eight by eight by eight playing field. Two variations of this embodiment are thereby made possible. In the first variation, a duke starts in the same cell as a bishop, and dukes and bishops can occupy the same position at any given time. They may even move as one piece, as long as the advancement squares for both pieces are unblocked. Also, if both pieces occupy the same position when one is captured, both pieces are captured. In the second variation, the duke is omitted, but the duke-type move is permitted for the composite pieces, such as a queen.

Further explanation, including opening strategies and examples of play, can be found in Goff, 3-D Chess (1st ed. October, 1990), the entire disclosure of which is hereby incorporated by reference.

Accordingly, it will be seen that this invention presents a unique and challenging form of three-dimensional chess. Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. A method of playing a three-dimensional chess game, comprising the steps of:

(a) providing a playing field, said playing field forming a cube divided into any array of cubic cells wherein a square set of cubic cells lies on any plane which slices through said cube and which cuts any face off said cube;

(b) arranging a plurality of playing pieces on said playing field, said playing pieces including a king, queen, bishop, duke, rook, knight, and pawn;

(c) movement of said playing pieces being generally confined to flat planes through said cubic cells;

(d) defining the position of any cubic cell as an intersection point of three intersecting orthogonal planes, each of which slices said cube cutting a face off said cube;

(e) movement of said rook playing piece defined as movement to any cubic cell of a square set of cubic cells lying on any one of the three orthogonal planes intersecting the cubic cell said rook playing piece is currently on, said square set of cubic cells being unoccupied by any other paying piece, said square set of cubic cells having a first corner coincident with the position of said rook playing piece prior to movement, said square set of cubic cells having a perimeter, the position of said rook playing piece after movement being coincident with a point on said perimeter, movement of said rook playing piece to cubic cells adjacent to said rook playing piece being generally confined to movement through adjoining faces of said adjacent cubic cells;

(f) defining the position of any cubic cell as an intersection point of four skew planes each of which slices said cube cutting at least one corner off said cube;

(g) movement of said bishop playing piece defined as movement to any cubic cell of a rhomboid set of cubic cells lying on any one of the four skew planes intersecting the cubic cell said bishop playing piece is currently on, said rhomboid set of cubic cells being unoccupied by any other playing piece, said rhomboid set of cubic cells having a first corner coincident with the position of said bishop playing piece prior to movement, said rhomboid set of cubic cells having a perimeter, the position of said bishop playing piece after movement being coincident with a point on said perimeter, movement of said bishop playing piece to cubic cells adjacent to said bishop playing piece being generally confined to movement through adjoining edges of said adjacent cubic cells;

(h) defining the position of any cubic cell as an intersection point of six slant planes each of which slices said cube cutting one full edge off said cube; and (i) movement of said duke playing piece defined as movement to any cubic cell of a square set of cubic cells lying on any one of the sic slant planes intersecting the cubic cell the duke playing piece is currently on, said square set of cubic cells being unoccupied by any other playing piece, said square set of cubic cells having a first corner coincident with the position of said duke playing piece prior to movement, said square set of cubic cells having a perimeter, the position of said duke playing piece after movement being coincident with a point on said perimeter, movement of said duke playing piece to cubic cells adjacent to said duke playing piece being generally confined to movement through adjoining corners of said adjacent cubic cells.

2. The method recited in claim 1, wherein castling occurs in either of two vertical orthogonal planes through said playing field.

3. The method recited in claim 1, wherein said step of providing a playing field includes the step of positioning a plurality of playing boards at vertically spaced levels, each said playing board being generally flat, each said playing board surface being divided into a grid of squares, the number of said squares on each edge of each said playing board being equal, said plurality of playing boards defining said plurality of cubic cells in said playing field.

4. The method recited in claim 3, wherein said pawn playing piece may capture any of said playing pieces only on a playing board vertically adjacent to the playing board occupied by said pawn playing piece.

5. The method recited in claim 3, further comprising the steps of:

(a) dividing said playing pieces into two distinguishable sets, each of said sets having twenty playing pieces, each of said sets of playing pieces including major playing pieces, said major playing pieces including one king, one queen, two bishops, two dukes, two knights and two rooks, each of said sets of playing pieces including ten pawns;

(b) positioning each of said sets of playing pieces at opposing edges of said playing field in vertical alignment at the start of the game; and (c) positioning said pawn playing pieces diagonally in front of said major playing pieces by one cell.

6. The method recited in claim 3, wherein said duke playing piece and said bishop playing piece are permitted to occupy the same cell at any time.

7. A method of enabling the play of a three-dimensional cubic planar chess game, comprising the steps of:

(a) providing a playing field, said playing field including a plurality of playing levels, said playing levels positioned at vertically spaced intervals, each said playing level being generally flat, each said playing level surface being divided into a grid of squares, the number of said squares on each edge of each said playing level being equal, said plurality of playing levels forming a cube divided into an array of cubic cells wherein a square set of cubic cells lie on any plane which slices through said cube and which cuts any face off said cube;

(b) positioning a plurality of playing pieces on said playing field, movement of said playing pieces being generally confined to flat planes through said cubic cells;

(c) said playing pieces including three base pieces, said base pieces including a rook, bishop, and duke;

(d) defining the position of any cubic cell as an intersection point of three intersecting orthogonal planes, each of which slices said cube cutting a face off said cube;

(e) movement of said rook playing piece defined as movement to any cubic cell of a square set of cubic cells lying on any one of the three orthogonal planes intersecting the cubic cell said rook playing piece is currently on, said square set of cubic cells being unoccupied by any other playing piece, said square set of cubic cells having a first corner coincident with the position of said rook playing piece prior to movement, said square set of cubic cells having a perimeter, the position of said rook playing piece after movement being coincident with a point on said perimeter, movement of said rook playing piece to cubic cells adjacent to said rook playing piece being generally confined to movement through adjoining faces of said adjacent cubic cells;

(f) defining the position of any cubic cell as an intersection point of four skew planes each of which slices said cube cutting at least one corner off said cube;

(g) movement of said bishop playing piece defined as movement to any cubic cell of a rhomboid set of cubic cells lying on any one of the four skew planes intersecting the cubic cell said bishop playing piece is currently on, said rhomboid set of cubic cells being unoccupied by any other playing piece, said rhomboid set of cubic cells having a first corner coincident with the position of said bishop playing piece prior to movement, said rhomboid set of cubic cells having a perimeter, the position of said bishop playing piece after movement being coincident with a point on said perimeter, movement of said bishop playing piece to cubic cells adjacent to said bishop playing piece being generally confined to movement through adjoining edges of said adjacent cubic cells;

(h) defining the position of any cubic cell as an intersection point of six slant planes each of which slices said cube cutting one full edge off said cube; and (i) movement of said duke playing piece defined as movement to any cubic cell of a square set of cubic cells lying on any one of the six slant planes intersecting the cubic cell the duke playing piece is currently on, said square set of cubic cells being unoccupied by any other playing piece, said square set of cubic cells having a first corner coincident with the position of said duke playing piece prior to movement, said square set of cubic cells having a perimeter, the position of said duke playing piece after movement being coincident with a point on said perimeter, movement of said duke playing piece to cubic cells adjacent to said duke playing piece being generally confined to movement through adjoining corners of said adjacent cubic cells.

8. The method recited in claim 7, wherein said playing pieces include a king, castling occurring in either of two vertical orthogonal planes through said playing field.

9. The method recited in claim 8, wherein said playing pieces include a pawn, capturing by said pawn playing piece being limited to any of said playing pieces on any playing board adjacent to the playing board occupied by said pawn playing piece.

10. The method recited in claim 9, further comprising the steps of:

(a) dividing said playing pieces into two distinguishable sets, each of said sets having twenty playing pieces, each of said sets of playing pieces including major playing pieces, said major playing pieces including one king, one queen, two bishops, two dukes, two knights and two rooks, each of said sets of playing pieces including ten pawns;

(b) positioning each of said sets of playing pieces at opposing edges of said playing field in vertical alignment at the start of the game; and (c) positioning said pawn playing pieces diagonally in front of said major playing pieces by one cell.

11. The method recited in claim 10, wherein said duke playing piece and said bishop playing piece are permitted to occupy the same cell at any time.

* * * * *